US007069942B2

(12) United States Patent
Trefall et al.

(10) Patent No.: US 7,069,942 B2
(45) Date of Patent: Jul. 4, 2006

(54) METHOD AND APPARATUS FOR HANDLING OF COVERING GAS

(75) Inventors: Reidar Trefall, Rådal (NO); Kristian Utkilen, Bergen (NO)

(73) Assignee: ABB Gas Technology AS, Bergen (NO)

( * ) Notice: Subject to any disclaimer, the term of this patent is extended or adjusted under 35 U.S.C. 154(b) by 0 days.

(21) Appl. No.: 10/482,768

(22) PCT Filed: Jul. 3, 2002

(86) PCT No.: PCT/NO02/00247

§ 371 (c)(1),
(2), (4) Date: May 12, 2004

(87) PCT Pub. No.: WO03/010071

PCT Pub. Date: Feb. 6, 2003

(65) Prior Publication Data

US 2004/0200526 A1 Oct. 14, 2004

(30) Foreign Application Priority Data

Jul. 3, 2001 (NO) ..... 20013298

(51) Int. Cl.
*F04F 1/18* (2006.01)

(52) U.S. Cl. ..... 137/14; 137/210; 137/340

(58) Field of Classification Search ..... 137/14, 137/210, 340
See application file for complete search history.

(56) References Cited

U.S. PATENT DOCUMENTS 3,197,972 A * 8/1965 King ..... 62/48.1
5,165,246 A * 11/1992 Cipolla et al. ..... 137/210
5,678,423 A * 10/1997 Davies et al. ..... 62/613

FOREIGN PATENT DOCUMENTS

JP 56-81391 A * 7/1981

* cited by examiner

*Primary Examiner*—Kevin Lee
(74) *Attorney, Agent, or Firm*—Francis C. Hand; Carella, Byrne, Bain eta

(57) ABSTRACT

A method for the handling of covering gas or inert gas in connection with a tank that conveys crude oil, during successive discharging and loading operations of the tank, is disclosed. The method is characterized by the fact that covering gas/inert gas is re-circulated in an approximate closed circulation by the following steps: that during discharging of the tank, covering gas is produced in a recognized manner known per se from the cargo to fill the gradually increasing void space in the tank, and that when the tank is filled again with crude oil, the gas from the tank is extracted again, and it is compressed and absorbed into the stabilized crude oil. An apparatus is mentioned for accomplishing the method.

11 Claims, 1 Drawing Sheet

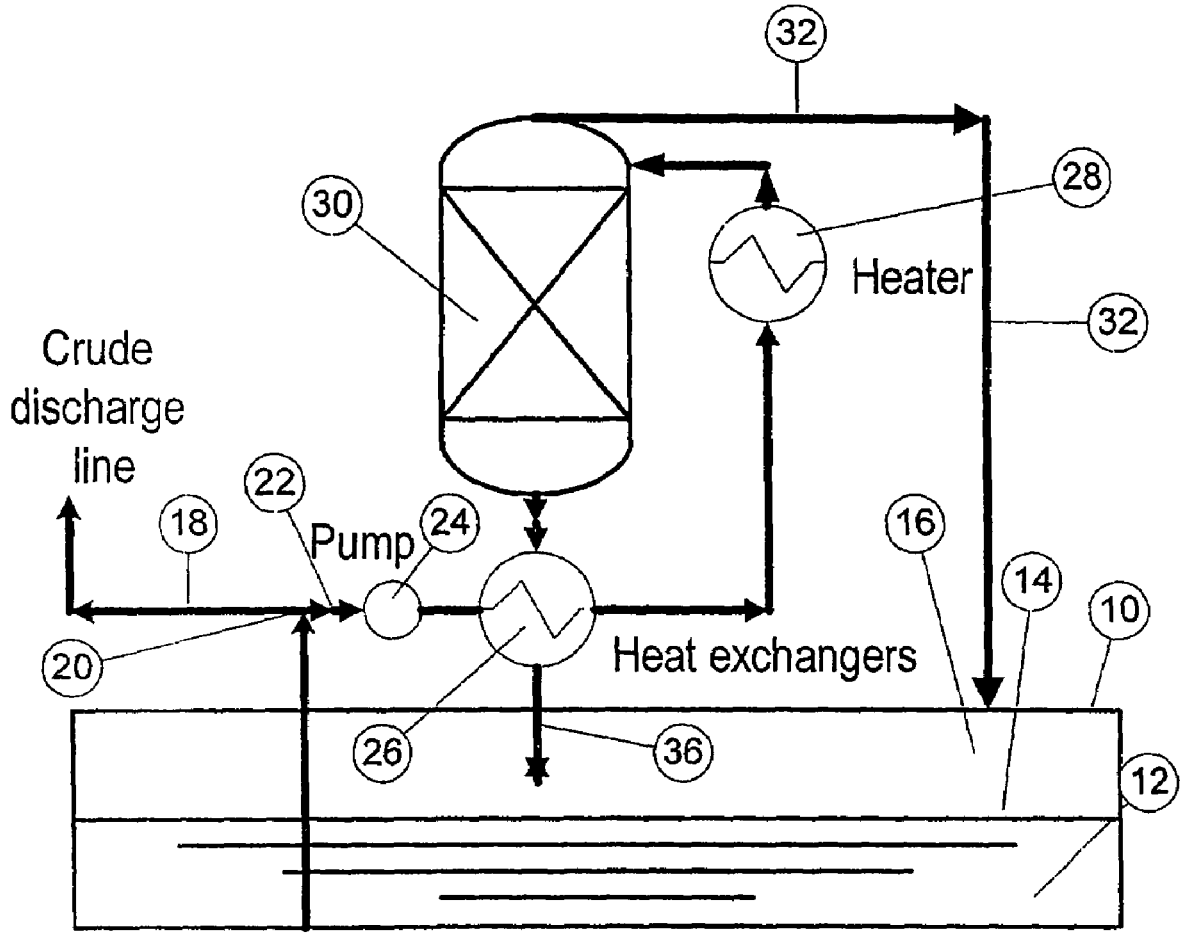
32
28
30
Heater
32
Crude
discharge
line
22
18
Pump
24
16
14
10
20
Heat exchangers
26
36
12

METHOD AND APPARATUS FOR HANDLING OF COVERING GAS

The invention presented here concerns a method and an apparatus for handling covering gas in a crude oil tank.

The loading and carriage of, for example, crude oil by vessel, leads to large emissions of cargo components such as hydrocarbon gas (HC) from oil cargoes, also termed VOC.

Today some vessels are equipped with an inert gas generator that burns oil/diesel. The exhaust that is cleaned with seawater will mainly consist of nitrogen, carbon dioxide and a small residue of oxygen.

Since there may be residues of flammable gases from the cargo in the tanks, the ingress of air could create an explosive mixtures which makes a safety hazard. As the cargo is delivered, the empty volume must be replenished with inert gas, to prevent oxygenated air from entering the tanks.

One problem with current methods is that the inert gas used for making the tank atmosphere safe leads to a higher level of vaporization of the cargo than necessary, plus the fact that inert gas is corrosive.

To procure another type of inert gas at various terminals will create a logistics problem since many sites will not have access to such gas. Further, there will be a need for converting vessels and terminals with connections and hoses for supplying a protective atmosphere to the tanks.

With regard to dealing with covering gas that is displaced during loading of liquids, many methods have been suggested for collecting these gases when loading, so that emissions to the air are reduced. One standard method is to use a compressor for compressing gas that is displaced from cargo tanks and to absorb the gas in the cargo.

The invention aims to present a new method of providing covering gas that eliminates all the disadvantages of plant in current use. The aim is thus to avoid emission from the cargo, avoid corrosion, avoid tie-up to platforms, terminals and similar, as well as to reduce energy consumption of compressor work by recovery of the gas, etc.

A second aim of the invention is to present a method whereby, in a simple manner, one can continually control that only the amount of covering gas necessary at any given time is produced.

Further, the invention aims to produce a system in which covering gas can be re-circulated on demand.

The method according to the invention is characterised by the covering gas/inert gas being re-circulated in a virtually closed circuit so that during discharging of the tank, covering gas is produced in a recognised manner known per se, from the cargo to fill the gradually increasing void space in the tank and so that, when the tank is filled again with crude oil, the gas from the tank is extracted again, and is compressed and absorbed into the stabilized crude oil.

The invention, accordingly, may be expressed by the fact that the covering gas or inert gas that is used is extracted from the actual cargo. This principle is recognised known per se from the transportation of liquefied natural gas (LNG) as described in U.S. Pat. Nos. 3,197,971 and 5,165,246. In these patents one allows a small part of the gas to vaporise so as to obtain overpressure for transporting the liquefied gas out of the tank.

This invention uses a particular property of crude oil, namely the ability to absorb and emit hydrocarbon gas. After being stabilised in the processing plant, the oil will contain a small amount of dissolved gas. This gas can be released and used for covering gas. The oil, in itself, will remain unchanged and will be able to absorb the covering in the tanks. In contrast to the foregoing US patents, the produced gas will not create a forward pressure for emptying the tank, but only serve as a covering gas with enough volume to prevent the ingress of air.

According to another aspect of the invention, an apparatus is defined that implies that the covering gas can now be re-circulated in a virtually closed circuit with hardly any emissions to air, and as follows:

1. During discharge of the tank, covering gas is produced, as stated in the foregoing, (i.e. from the actual cargo/crude oil) in order to fill the gradually increasing void space in the tank.
2. When the tank is filled once more with cargo, the tank gas is vented again, then compressed and absorbed in the cargo/crude oil.

The crude oil will act as a buffer tank where the gas will be taken out on demand and fed back when the gas volume diminishes in the cargo tanks.

With this invention, an explosive atmosphere is avoided by preventing the ingress of oxygen into the tank space. Accordingly, a gas mixture that has been extracted from the cargo is utilised as a sort of covering gas and not as a propellant gas. As and when the cargo is delivered, the void space must be replenished so that oxygenated air shall not enter into the tanks. Extracting the gas continually from the actual cargo now solves this matter.

One advantage of this new covering gas is also that the corrosion is reduced, since inert gas is not used with carbon dioxide and salt, which combine to form a highly corrosive atmosphere.

One example of the proposed method is based on combining such a covering gas producing plant with a facility for recovering covering gas by absorption.

When the vessel comes to the discharging terminal, a generator will recover covering gas from the cargo. This gas is used for replenishing the void space in the tank. After the vessel has delivered its cargo, the empty tanks will be protected by overpressure of gas that has been extracted from the cargo.

When the vessel comes to the loading buoy or production ship, the cargo will be filled up in the empty tanks. All covering gas will go to the absorption plant that will extract the gas and supply it to the new cargo. The covering gas is taken out again when discharging is done, thus forming a re-circulating system.

According to the invention, a gas generator can be designed in two ways. One can use either heat or vacuum to release the gas. A combination of methods is also possible. To increase vaporisation, one can let the crude oil occupy a wide surface by atomising it into droplets or by letting it circulate (run) over large areas. This can be produced by conveying some of the cargo into a combination tower that is used for absorption during recovery and degassing during discharging.

Another possibility is to use a nozzle system where the cargo is atomised by being sprayed into the tank under pressure. The cargo will emit gas to be used as covering gas as and when the tanks are discharged.

The following account gives a description of a gas generator that is based on heat. To reduce energy consumption with the method according to the invention, the hot cargo can be directed through a heat exchanger that preheats the cargo into the generator. By continually monitoring tank pressure and the amount discharged, one can control the amount directed through the gas generator, and consequently, one can regulate the production of gas that is conveyed back to the tank as covering gas.

The gas atmosphere, thus, will circulate by virtue of the fact that it is released at the terminal and combines with the cargo during the loading.

The example mentioned is detailed in the following description referring to the accompanying drawing, which shows a typical design of a gas generator for covering gas according to the invention.

The Drawing schematically illustrates an apparatus constructed in accordance with the invention.

The FIGURE shows a tank (10 that is partly filled with a fluid 12, as the volume above the fluid level 14 comprises a covering gas 16. A line 18 is used to supply load and remove discharge the tank 10 of crude oil. From a branching point 20 on the line 18 runs a line 22 via a pump 24 further through a heat exchanger 26, and a heat exchanger 28 to the upper part of the column 30. From the top of the column 30 runs a line 32 back to the top of the tank 10.

Use of the Apparatus According to the Invention

Discharging of the Tank 10

The FIGURE depicts a tank 10 that is about to be discharged through the line 18. By means of the pump 24 a small part of the cargo is extracted in the line 22, and passes through the heat exchanger 26 and the heat exchanger 28 whereupon a part of the extracted cargo vaporizes. Additional vaporization is obtained by means of spraying it into the top of the column 30 to attain further vaporization. In gas form the covering gas is then conducted to the tank top and the remaining cargo is cooled and returned.

Normally, only a part of the extracted fluid will vaporize, and the rest of the liquid cargo will run back to the cargo through the line 36.

Loading of the Tank 10

In this situation the tank 10 is filled with liquid. The filling of the cargo is done through the line 18. The gas is now recovered through a standard absorption plant where the absorption column could be the same as the degassing column during discharge.

During the filling of the tank, the column 30 is used to absorb covering gas that is drawn off from the tank, since the covering gas is pressurized and absorbed in a cargo fluid that is led through the column 30.

The invention claimed is:

1. Apparatus for the handling of covering gas or inert gas in connection with a tank conveying crude oil, during successive discharging and loading operations of the tank, characterised by a circulation for re-circulating covering gas/inert gas, comprising:

means of vaporization of a unit of cargo for the production of said covering gas, and means for filling a gradually increasing void space in the tank with covering gas, and an means for venting gas from the tank, as well as a means of compressing and absorption of the released tank gas.

2. Apparatus according to claim 1, characterised by a cargo tank (10), a loading and discharge tine (18), a branch pipe (22) with pump (22) for the venting of a unit of cargo, means (24,28) for tempering the unit of cargo, a column (30) for atomisation/vaporization of the cargo unit, in that a first stage line (32) connects the top of the column (30) to the cargo tank (10) and a second line (36) connects the base of the column (30) to the cargo tank (10).

3. A recycling circuit for the handling of a covering gas during successive discharging and loading operations of a tank conveying crude oil, said circuit comprising a line for selectively discharging crude oil from and delivering crude oil to a tank;

a branch pipe extending from said line for venting a unit of the crude oil from said line during a discharge of crude oil from a tank and during delivery of crude oil to a tank;

at least one heat exchanger in said branch pipe for heating the unit of crude oil passing therethrough;

a column connected to said branch line for receiving the heated unit of crude oil therefrom and for separating vaporized gas from the heated unit of crude oil during a discharge of crude oil from a tank and for introducing gas into the unit of crude oil during delivery of crude oil to a tank;

a first line extending from an upper end of said column for selectively delivering the separated gas in said column to the tank as a covering gas during a discharge of crude oil from a tank and for delivering covering gas from a tank to said column during delivery of crude oil to a tank; and a second line extending from a lower end of said column for returning crude oil in said column to the tank during a discharge of crude oil from a tank and during delivery of crude oil to a tank.

4. A method of handling a covering gas in a tank for conveying crude oil during a discharge operation and during a loading operation, said method comprising the steps of extracting a covering gas from a tank into a closed circuit during discharge of crude oil from a tank and recycling the extracted covering gas into the tank from said closed circuit during the discharge of crude oil from the tank to fill a gradually increasing void space in the tank;

thereafter extracting the covering gas from the tank into said closed circuit during a subsequent delivery of crude oil into the tank;

mixing the extracted covering gas with a portion of the crude oil being delivered to the tank in said closed circuit for absorption therein; and delivering the portion of crude oil with the covering gas therein to the tank.

5. A method as set forth in claim 4 wherein said step of extracting the covering gas includes extracting a unit of crude oil from a flow of crude oil being discharged from a tank into said closed circuit and separating gas therefrom.

6. A method as set forth in claim 5 wherein said step of extracting the covering gas includes heating the extracted unit of crude oil and separating vaporized gas therefrom in the closed circuit during a discharge of crude oil from the tank.

7. A method as set forth in claim 6 wherein the vaporized gas is separated under vacuum.

8. A method as set forth in claim 4 wherein the extracted gas is atomized for mixing with the portion of the crude oil being delivered to the tank in said closed circuit for absorption therein.

9. A method as set forth in claim 8 wherein the portion of the crude oil in said closed circuit is sprayed to form droplets for mixing with the extracted gas in said closed circuit.

10. A method as set forth in claim 4 further comprising the steps of generating a covering gas from a cargo of crude oil in a tank during transport and forming a layer thereof over the cargo.

11. A method as set forth in claim 4 further comprising the step of maintaining the layer of covering gas in the tank at an overpressure.

* * * * *